US010113435B2

(12) United States Patent
Pater

(10) Patent No.: US 10,113,435 B2
(45) Date of Patent: Oct. 30, 2018

(54) COATED GAS TURBINE COMPONENTS

(75) Inventor: Christopher M. Pater, Tolland, CT (US)

(73) Assignee: United Technologies Corporation, Farmington, CT (US)

( * ) Notice: Subject to any disclaimer, the term of this patent is extended or adjusted under 35 U.S.C. 154(b) by 1573 days.

(21) Appl. No.: 13/184,136

(22) Filed: Jul. 15, 2011

(65) Prior Publication Data

US 2013/0014510 A1 Jan. 17, 2013

(51) Int. Cl.
*F23R 3/00* (2006.01)
*F01D 5/28* (2006.01)
(Continued)

(52) U.S. Cl.
CPC ..... *F01D 5/288* (2013.01); *F01D 5/18* (2013.01); *F01D 25/08* (2013.01); *F23R 3/002* (2013.01); *F23R 3/06* (2013.01); *F05D 2230/312* (2013.01); *F05D 2230/90* (2013.01); *F05D 2260/202* (2013.01); *F05D 2300/20* (2013.01); *F05D 2300/502* (2013.01);
(Continued)

(58) Field of Classification Search
CPC .. F23R 3/00; F23R 3/002; F23R 3/005; F23R 3/007; F23R 3/02; F23R 3/04; F23R 3/045; F23R 3/06; F23R 3/08; F23R 3/10; F23R 3/12; F23R 3/14; F23R 3/16; F23R 3/18; F23R 3/20; F23R 3/22; F23R 3/24; F23R 3/26; F23R 2900/00018; F01D 5/288; F01D 5/18; F01D 25/08; F05D 2230/312; F05D 2230/90; F05D 2300/20; F05D 2300/502; F05D 2300/611; F05D 2260/202
USPC ..... 60/752, 753, 754, 755, 756, 757, 758, 60/759, 760; 415/115; 29/458
See application file for complete search history.

(56) References Cited

U.S. PATENT DOCUMENTS 2,149,510 A * 3/1939 Darrieus ..... 416/90 R
5,097,660 A * 3/1992 Shekleton ..... 60/806
(Continued)

FOREIGN PATENT DOCUMENTS

EP 0269551 A2 6/1988
EP 1437194 A2 7/2004
(Continued)

OTHER PUBLICATIONS

Mao, W.G. Effects of Substrate Curvature Radius, Deposition Temperature and Coating Thickness on the Residual Stress Field of Cylindrical Thermal Barrier Coatings. Surface and Coatings Technology Journal. Nov. 11, 2010.*
(Continued)

*Primary Examiner* — Ehud Gartenberg
*Assistant Examiner* — Jason H Duger
(74) *Attorney, Agent, or Firm* — Kinney & Lange, P.A.

(57) ABSTRACT

A gas turbine component subject to extreme temperatures and pressures includes a wall defined by opposite first and second surfaces. An airflow aperture through the wall is defined by an aperture wall surface which extends from a first opening in the first surface to a second opening in the second surface. The aperture wall surface is flared at a juncture with the first surface, such that the first opening has a greater cross-sectional flow area than the second opening. A high-pressure, high-temperature coating is adhered to the first surface, and adhered to at least a portion of the aperture wall surface.

19 Claims, 3 Drawing Sheets

(51) Int. Cl.

| | |
|---|---|
| ***F01D 5/18*** | (2006.01) |
| ***F01D 25/08*** | (2006.01) |
| ***F23R 3/06*** | (2006.01) |
| *F23R 3/08* | (2006.01) |

(52) U.S. Cl.
CPC ..... *F05D 2300/611* (2013.01); *F23R 3/08* (2013.01); *F23R 2900/00018* (2013.01)

(56) References Cited

U.S. PATENT DOCUMENTS

| | | | | |
|---|---|---|---|---|
| 5,382,133 | A * | 1/1995 | Moore et al. | 415/115 |
| 5,771,577 | A * | 6/1998 | Gupta et al. | 29/889.721 |
| 5,941,686 | A * | 8/1999 | Gupta et al. | 415/178 |
| 6,050,777 | A * | 4/2000 | Tabbita et al. | 416/97 R |
| 6,139,258 | A * | 10/2000 | Lang et al. | 415/116 |
| 6,210,112 | B1 * | 4/2001 | Tabbita et al. | 416/97 R |
| 6,210,488 | B1 * | 4/2001 | Bruce | 134/1 |
| 6,241,468 | B1 * | 6/2001 | Lock et al. | 415/115 |
| 6,243,948 | B1 * | 6/2001 | Lee et al. | 29/889.1 |
| 6,287,075 | B1 * | 9/2001 | Kercher | 416/97 R |
| 6,329,105 | B1 | 12/2001 | Fujita et al. | |
| 6,368,060 | B1 | 4/2002 | Fehrenbach et al. | |
| 6,416,283 | B1 | 7/2002 | Johnson et al. | |
| 6,438,958 | B1 * | 8/2002 | McCaffrey et al. | 60/752 |
| 6,573,474 | B1 | 6/2003 | Loringer | |
| 6,744,010 | B1 | 6/2004 | Pepe et al. | |
| 7,019,257 | B2 * | 3/2006 | Stevens | 219/121.71 |
| 7,374,401 | B2 * | 5/2008 | Lee | 416/97 R |
| 7,812,282 | B2 | 10/2010 | Kuhn et al. | |
| 7,816,625 | B2 | 10/2010 | Beck et al. | |
| 7,887,294 | B1 * | 2/2011 | Liang | 416/97 R |
| 8,066,484 | B1 * | 11/2011 | Liang | 416/97 R |
| 8,092,176 | B2 * | 1/2012 | Liang | 416/96 R |
| 8,657,576 | B2 * | 2/2014 | Tibbott et al. | 416/96 R |
| 8,672,613 | B2 * | 3/2014 | Bunker | 415/115 |
| 2007/0036942 | A1 | 2/2007 | Steele | |
| 2009/0003988 | A1 * | 1/2009 | Campbell | 415/115 |
| 2009/0324387 | A1 * | 12/2009 | Turaga | 415/115 |
| 2010/0011775 | A1 | 1/2010 | Garry et al. | |
| 2010/0068032 | A1 | 3/2010 | Liang | |
| 2010/0068033 | A1 * | 3/2010 | Liang | 415/115 |
| 2011/0036819 | A1 | 2/2011 | Munzer et al. | |

FOREIGN PATENT DOCUMENTS

| | | | |
|---|---|---|---|
| EP | 1510283 | A1 | 3/2005 |
| JP | 2008229842 | | 10/2008 |
| WO | WO2005021205 | A1 | 3/2005 |

OTHER PUBLICATIONS

Extended European Search Report for EP Application No. 12176611.7, dated Dec. 7, 2016, 8 pages.

* cited by examiner

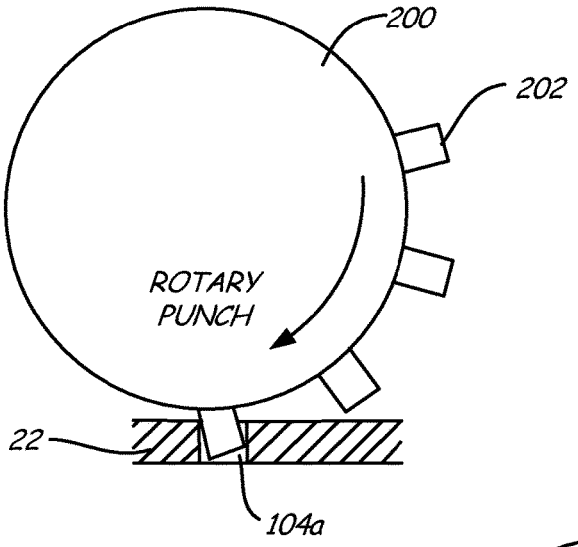
FIG. 5A
FIG. 5B
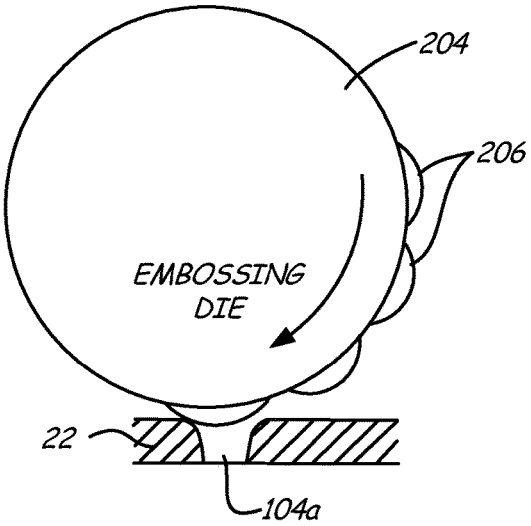
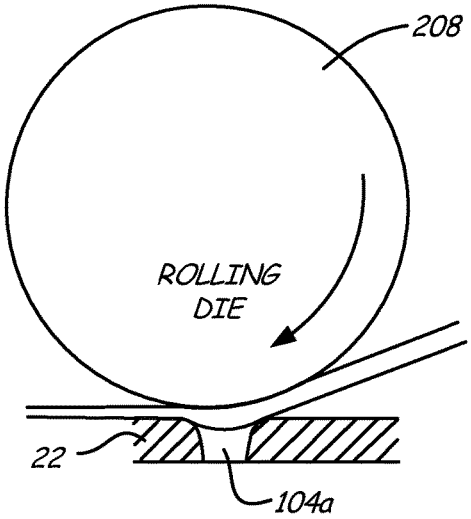
FIG. 5C

COATED GAS TURBINE COMPONENTS

BACKGROUND

The present invention relates generally to coated gas turbine components, and more particularly components having airflow apertures and protective coatings.

Combustion chambers are engine sections which receive and combust fuel and high pressure gas. Gas turbine engines utilize at least one combustion chamber in the form of a main combustor which receives pressurized gas from a compressor, and expels gas through a turbine which extracts energy from the resulting gas flow. Some gas turbine engines utilize an additional combustion chamber in the form of an afterburner, a component which injects and combusts fuel downstream of the turbine to produce thrust. All combustion chambers, including both main-line combustors and afterburners, are constructed to withstand high temperatures and pressures.

Combustion chambers and other high-temperature gas turbine components vary greatly in geometry depending on location and application. All combustion chambers comprise a plurality of walls or tiles which guide and constrain gas flow, typically including a liner which surrounds a combustion zone within the combustion chamber. Liners and some other combustion chamber walls are conventionally ventilated with numerous air holes or apertures for cooling. Conventional apertures for this purpose are holes with walls normal to the surface of the liner. Some combustion chamber walls, including liners for main-line combustors and afterburners, receive thermal barrier coatings, coatings for erosion prevention, or radar absorbent coatings to reduce the radar profile of exposed portions of the turbine. Such coatings must withstand exceptionally high temperatures and pressures, and are frequently formed of brittle ceramics which are vulnerable to fracturing and delamination. Coatings in other high-temperature, high-pressure areas of gas turbines, particularly on combustor nozzles and hot turbine blades and vanes, share similar design requirements.

According to some prior art techniques, cooling apertures have been bored or punched in combustion chamber walls after coating deposition. More recent techniques apply coatings to combustion chamber walls and other gas turbine components after the formation of apertures. When using either technique, coatings near apertures are especially vulnerable to mechanical stresses, and are prone to fracture, ablate and delaminate from the substrate combustion chamber wall. A design solution is needed which reduces the stresses on combustion chamber wall coatings at aperture locations.

SUMMARY

The present invention is directed toward a gas turbine component subject to extreme temperatures and pressures. The gas turbine component includes a wall defined by opposite first and second surfaces. An airflow aperture through the wall is defined by an aperture wall surface which extends from a first opening in the first surface to a second opening in the second surface. The aperture wall surface is flared at a juncture with the first surface, such that the first opening has a greater cross-sectional flow area than the second opening. A high-pressure, high-temperature coating is adhered to the first surface, and adhered to at least a portion of the aperture wall surface.

BRIEF DESCRIPTION OF THE DRAWINGS

FIGS. 5A, 5B, and 5C are simplified cross-sectional views illustrating formation of the cooling aperture of FIG. 2A using a rotary machine tools.

DETAILED DESCRIPTION

Figure 1:
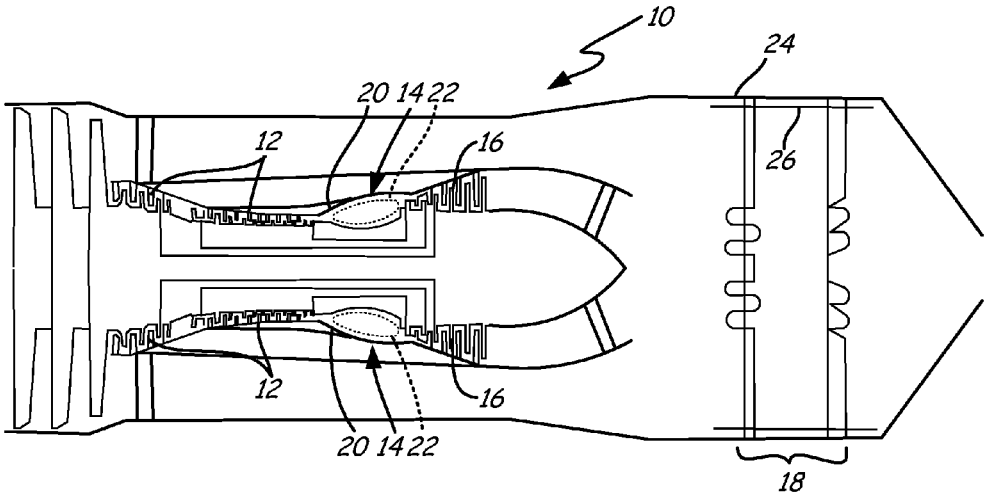
FIG. 1 is a schematic view of a gas turbine engine.

FIG. 1 is a schematic view of gas turbine engine 10, comprising compressor 12, combustor 14, turbine 16, and afterburner 18. Combustor 14 has combustor outer wall 20 and combustor liner 22, and afterburner 18 has afterburner outer wall 24 and afterburner liner 26. Compressor 12 receives and pressurizes environmental air, and delivers this pressurized air to combustor 14. Combustor 14 injects fuel into this pressurized air, and ignites the resulting fuel-air mixture. Turbine 16 receives gas flow from combustor 14, and extracts much of the kinetic energy of this airflow to power compressor 12 and other systems, potentially including an electrical generator (not shown). Exhaust from turbine 16 passes through afterburner 18, wherein additional fuel is injected, and the resulting fuel-air mixture ignited to produce thrust.

Combustor outer wall 20 is a first rigid heat-resistant barrier which defines the outer extent of combustor 14. Combustor liner 22 is a second rigid heat-resistant barrier, such as of nickel alloy, with a plurality of cooling apertures, as described with respect to FIGS. 2A-2D. These cooling apertures supply a thin film of cooling air to the interior of combustor liner 22.

The operation of afterburner 18 largely parallels the operation of combustor 14. Afterburner outer wall 24 and afterburner liner 26 are rigid heat-resistant barriers, and afterburner liner 26 features a plurality of cooling apertures, like combustor liner 22. These apertures provide a film of cooling air to the interior of afterburner liner 26, where fuel is injected and combusted to provide additional thrust.

Combustor liner 22 and afterburner liner 26 receive coatings such as thermal barrier coatings. These coatings must withstand extreme temperatures and pressures for extended periods. To improve the adhesion of these coatings to combustor liner 22 and afterburner liner 26 in such high temperatures and pressures, apertures in combustor liner 22 and afterburner liner 26 are formed in geometries described below with respect to FIGS. 2A-2D to increase the aperture wall surface area on which coating is deposited and to reduce stress in the coating that can lead to failure of the coating at or near the apertures.

FIGS. 2A, 2B, 2C, and 2D depict various embodiments of aperture 104 (i.e. apertures 104*a*, 104*b*, 104*c*, and 104*d*) in combustor liner 22. Although description is provided in terms of combustor liner 22, it will be understood by those skilled in the art that apertures 104*a*, 104*b*, 104*c*, and 104*d* may be cooling holes in any appropriate combustion chamber wall, such as afterburner liner 26.

Figure 2A:
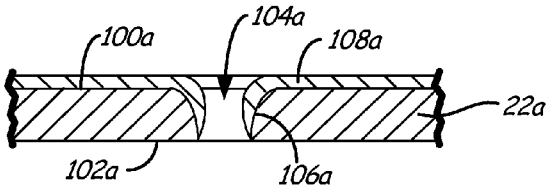
FIGS. 2A, 2B, 2C, and 2D are cross-sectional views of cooling apertures in an engine combustion chamber wall of FIG. 1.

FIG. 2A depicts one embodiment of combustor liner 22. Although description hereinafter will focus on apertures in combustor liner 22 (see FIG. 1), those skilled in the art will recognize that the aperture geometries disclosed herein may be utilized for cooling holes in afterburner liner 26, or in other coated high-temperature and high-pressure gas turbine structures, such as in coated airfoil blade or vane surfaces, nozzle flaps, or nozzle seals. FIG. 2A shows combustor liner 22*a* having first surface 100*a* and second surface 102*a* interrupted by aperture 104*a*. First surface 100 and second surface 102 define opposite sides of combustor liner 22*a*. First surface 100*a* may, for instance, be an inner surface of combustor liner 22, and second surface 102*a* may, for instance, be an outer surface of combustor liner 22.

Aperture 104*a* is a cooling hole extending through liner 22*a* along an axis normal to liner first surface 100*a*. Aperture 104*a* is defined and bounded in liner 22*a* by aperture wall surface 106*a*. Aperture wall surface 106*a* spans between first surface 100*a* and second surface 102*a*. Coating 108*a* is deposited atop first surface 100*a*, and infiltrates aperture 104*a* to at least partially cover aperture wall surface 106*a*, as shown. Coating 108 is a high-temperature and high-pressure resistant coating such as a ceramic-based plasma spray coating. Aperture 104*a* may be a cooling hole through combustor liner 22*a*. Aperture wall surface 106*a* may be substantially symmetric across a midpoint of aperture 104*a*, and is flared where it meets first surface 100*a*. In particular, aperture wall surface 106*a* meets first surface 100*a* in circular, elliptical, or polygonal hole perimeter. Aperture wall surface 106*a* is angled at a uniform obtuse angle relative to first surface 100*a*, at this hole perimeter. In particular, aperture wall surface 106*a* is curved continuously from first surface 100*a* at this hole perimeter. In other embodiments, aperture wall surface 106*a* may be sloped, flared, beveled or chamfered at the hole perimeter where it meets first surface 100*a*, as discussed in further detail below with respect to FIGS. 2B, 2C, and 2D. Aperture 104*a* thus diverges from a narrow opening at second surface 102*a* to a wider opening at surface 100*a*, i.e. an opening with a greater cross-sectional flow area. This curve, slope, flare, bevel, of chamfer at the hole perimeter provides a vector component of aperture wall surface 106*a* parallel to first surface 100*a*.

Coating 108*a* is applied, for example, by physical vapor deposition in a direction normal to first surface 100*a*, and is thus able to adhere to aperture wall surface 106*a*. Aperture wall surface 106*a* has a tapered segment generally contiguous to first surface 100*a* onto which coating 108*a* can be deposited inside aperture 104*a*. The curve (or, alternatively, slope, flare, bevel, or chamfer) at the juncture of aperture wall surface 106*a* and first surface 100*a* provides a less abrupt angular transition from first surface 100*a* to aperture wall surface 106*a*, dramatically reducing stress on coating 108 around aperture 104*a* as discussed in detail with respect to FIGS. 3 and 4. In addition, this contour at the juncture of aperture wall surface 106*a* and first surface 100*a* allows coating 108*a* to adhere to at least a portion of aperture wall surface 106*a*, thereby reduces ablation and delamination of coating 108*a* near aperture 104*a*.

Figure 2B:
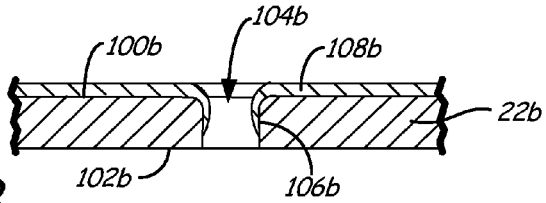

FIG. 2B depicts an alternative embodiment of combustor liner 22 (or other coated gas turbine structure, as discussed above). FIG. 2B generally parallels FIG. 2A both in structure and numbering, and depicts similar combustor liner 22*b* having first surface 100*b* and second surface 102*b* interrupted by aperture 104*b*. Aperture 104*b* has aperture wall surface 106*b*, a substantially symmetric surface which, like aperture wall surface 106*a*, is flared in a continuous curve near first surface 100*b*, but which is cylindrically shaped near second surface 102*b* Like aperture wall surface 106*a*, aperture wall surface 106*b* diverges from an opening at second surface 102*b* to a wider opening at first surface 100*b*, thereby providing a region of aperture wall surface 106*b* on which coating 108*b* is deposited. The flared juncture between first surface 100*b* and aperture wall surface 106*b* reduces stress on coating 108*b* at the hole perimeter of aperture 104*b* by reducing the abruptness of the angular transition between first surface 100*b* and aperture wall surface 106*b*, thereby decreasing the chance of ablation or delamination of coating 108*b*.

Figure 2C:
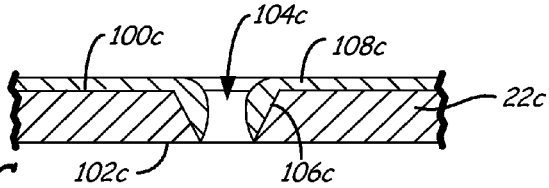

FIG. 2C depicts an alternative embodiment of combustor liner 22 (or other coated gas turbine structures, as discussed above). FIG. 2C generally parallels FIGS. 2A and 2B both in structure and numbering, and depicts similar combustor liner 22*c* having first surface 100*c* and second surface 102*c* interrupted by aperture 104*c*. Aperture wall surface 106*c* of aperture 104*c* has a frusto-conical, uncurved cross-sectional profile from first surface 100*c* to second surface 102*c*. Like aperture wall surfaces 106*a* and 106*b*, aperture wall surface 106*c* diverges from an opening in second surface 102*c* to a wider opening in second surface 100*c*. Similarly to aperture wall surfaces 106*a* and 106*b*, aperture wall surface 106*c* is flared or inclined at a hole perimeter where it meets first surface 100*c*, thereby providing a less abrupt angular transition from first surface 100*c* to aperture wall surface 106*c* which reduces strain on coating 108*c* and allows coating 108*c* to adhere to at least a region of aperture wall surface 106*c*.

Figure 2D:
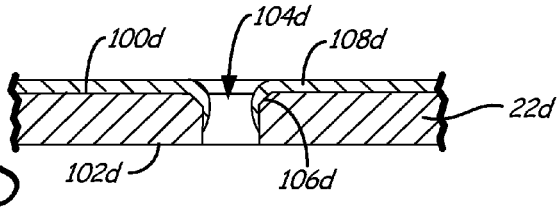

FIG. 2D depicts an alternative embodiment of combustor liner 22 (or other coated gas turbine structures, as discussed above). FIG. 2D generally parallels FIGS. 2A, 2B, and 2C in structure and numbering, and depicts similar combustor liner 22*d* having first surface 100*d* and second surface 102*d* interrupted by aperture 104*d*. Aperture wall surface 106*d* has a symmetric frusto-conical cross-sectional profile near first surface 100*d*, and a cylindrical profile near second surface 102*d*. This chamfer at the junction of first surface 100*d* and aperture wall surface 106*d* reduces the abruptness of the angular transition between first surface 100*d* and aperture wall surface 106*d*, reducing strain on coating 108*d* near aperture 104*d*. Like aperture wall surfaces 106*a*, 106*b*, and 106*c*, the flare of aperture wall surface 106*d* near first surface 100*d* allows at coating 108*d* to be adhered to at least a portion of aperture wall surface 106*d*, reducing the chance of delamination or ablation of coating 108*d* near aperture 104*d*.

Figure 3:
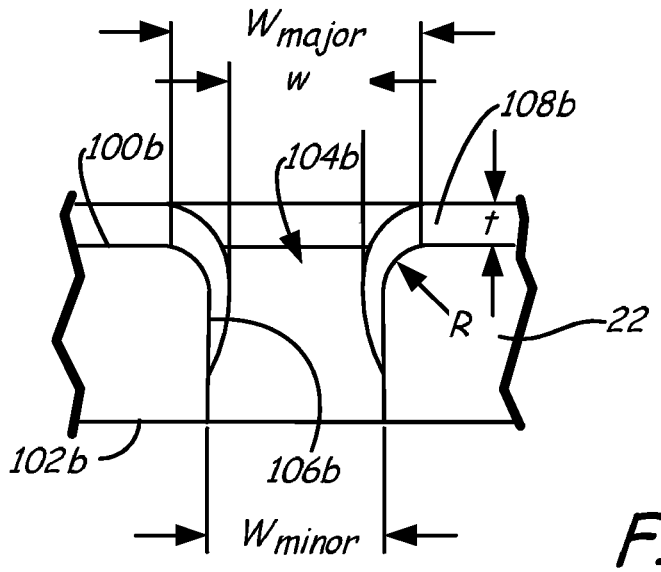
FIG. 3 is a cross-sectional view of the cooling aperture of FIG. 2B, illustrating relevant geometry.
Figure 4:
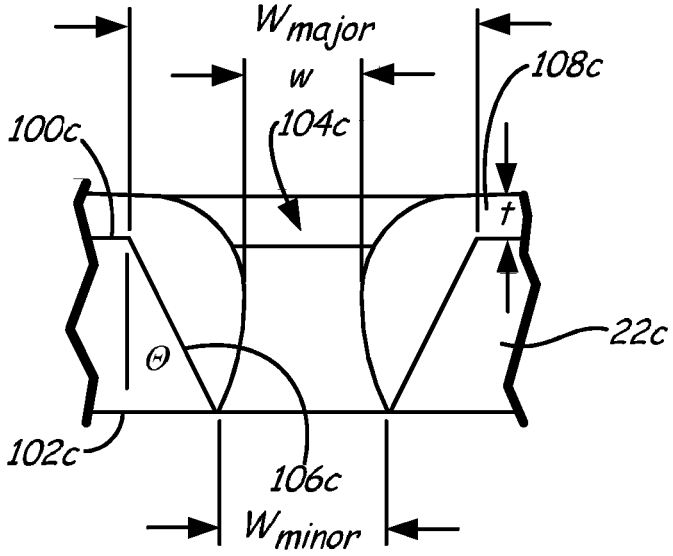
FIG. 4 is a cross-sectional view of the cooling aperture of FIG. 2C, illustrating relevant geometry.

FIGS. 3 and 4 illustrate dimensions of apertures 104*b* and 104*c* of FIGS. 2B and 2C, respectively. Although apertures 104*b* and 104*c* are described as substantially circular holes, one skilled in the art will recognize that the present invention may similarly be applied to elliptical, rectangular, and other polygonal holes.

FIG. 3 illustrates combustor liner 22*b* with first surface 100*b*, second surface 102*b*, coating 108*b*, and aperture 104*b* with aperture wall surface 106*b*. The minimum width of aperture 104*b* defines minor width $W_{minor}$, while the maximum width of aperture 104*b* defines major width $W_{major}$, as shown. In the case of a circular hole, $W_{minor}$ and $W_{major}$ are minimum and maximum diameters of aperture 104*b*, respectively. Applying coating 108 further reduces the effective aperture width of aperture 104*b* to flow width w, which corresponds to the usable cross-sectional area of aperture 104*b* for airflow purposes. Coating 108*b* has coating thickness t, and aperture wall surface 106*b* has radius of curvature r. This curvature of aperture wall surface 106*b* reduces the abruptness of the angular transition from first surface 100*b* to aperture wall surface 106*b*, thereby reducing stress on coating 108*b* relative to flat aperture wall surfaces perpendicular to first surface 100*b*. As an illustrative example, coating stress k drops by more than a factor of 2 as radius of curvature r approaches coating thickness t:

$$\text{For } \frac{r}{t} = 0,\ k = 2.5 \quad \text{[Equation 1]}$$

(cylindrical apertures)

$$\text{For } \frac{r}{t} = 1,\ k = 1.2 \quad \text{[Equation 2]}$$

(aperture 104*b*, as *r* approaches *t*)

(Young, Warren C., *Roark's Formulas for Stress & Strain,* 6th Ed.)

As radius of curvature r increases, aperture wall surface 106*b* approaches aperture wall surface 106*a*. Larger radii of curvature r reduce strain on coating 108, decreasing the likelihood of coating ablation or delamination.

FIG. 4 parallels FIG. 3, and depicts combustor liner 22*c* with first surface 100*c*, second surface 102*c*, coating 108*c*, and aperture 104*c* with aperture wall surface 106*c*. Aperture wall surface 106*c* is not curved, but is angled at surface angle Θ relative to normal to first surface 100*c*. Angle Θ provides a less abrupt angular transition for coating 108 at aperture 104*c*, introducing an effective nonzero radius of curvature to the transition between first surface 100*c* and aperture wall surface 106*c* which reduces coating stress k in a manner qualitatively similar to the stress reduction described above with respect to FIG. 3.

In addition to improving the stress characteristics of coating 108*c* near apertures, the present invention increases the area of coating adhesion on aperture wall surface 106*c*. For example, the area of coating adhesion on aperture wall surface 106*c* of a circular aperture 104*c* can be expressed as:

$$A_{adh} = \frac{\pi}{2(W_{major} + W_{minor})\sqrt{\frac{1}{4}(W_{major} - W_{minor})^2 + t}} \quad \text{[Equation 3]}$$

The areas of coating adhesion on aperture wall surfaces 106*a*, 106*b*, and 106*d* is similarly increased over prior art cylindrical apertures. This increased adhesion area reduces the likelihood of ablation or delamination of coating 108*c*.

Flow width w is predictable from coating thickness t and the geometry of aperture 104. For a circular aperture 104*c*:

$$w = \frac{W_{major} - W_{minor}}{2} - 2t\sin\Theta \quad \text{[Equation 4]}$$

A desired flow width w can be produced by selecting an appropriate deposition rate of coating 108*c* and appropriate dimensions for aperture 104*c*. In this way, aperture 104*c* can be constructed with desired cross-sectional area for cooling airflow. Flow width w is similarly predictable for apertures 104*a*, 104*b*, and 104*d*.

Aperture wall surface 106*c* is flared where it meets first surface 100*c*. This geometry provides area for coating 108 to adhere to aperture wall surface 106*c*, reducing strain on coating 108*c* near apertures 104*c*. Aperture wall surfaces 106*a*, 106*b*, and 106*d* reduce coating strain analogously.

FIGS. 5A, 5B, and 5C depict possible steps in the formation of aperture 104*a*. These steps can alternatively be used to fabricate apertures 104*b*, 104*c*, or 104*d*. Apertures can generally be formed by a variety of methods, including casting, machine stamping, electrodischarge machining, and laser boring. FIGS. 5A, 5B, and 5C depict only a few possible fabrication methods.

FIG. 5A depicts rotary punch 200 and combustor liner 22. Rotary punch 200 is a rotating machining tool with punch heads 202. Punch heads 202 punch holes through combustor liner 22 as a first step in formation of apertures 104*a*. Punch heads 202 may be circular, elliptical, rectangular, or other polygonal punches, and may have widths or diameters selected to produce desired dimensions of apertures 104*a*, such as minor width $W_{minor}$. As rotary punch 200 turns, punch heads 202 rotate one by one into alignment with desired locations for apertures 104*a*. Punch heads 202 then press through combustor liner 22, punching out sections corresponding to apertures 104*a*.

FIG. 5B depicts embossing die 204 and combustor liner 22. Embossing die 204 is a rotating machining tool with embossing posts 206. Embossing posts 206 emboss combustor liner 22 at the locations of holes formed by rotary punch 200. Embossing posts 206 turn into position with locations of apertures 104*a*, and press into combustor liner 22 to mold holes formed by rotary punch 200 into the desired geometry of apertures 104*a* (or, alternatively, any other aperture of the present invention, such as 104*b*, 104*c*, or 104*d*).

FIG. 5C depicts rolling die 208, ductile sheet stock 210, and combustor liner 22. As an alternative to embossing die 204, rolling die 208 can be used to mold holes formed by rotary punch 200 into the desired geometry of apertures 104*a* (or other aperture geometries). Rolling die 208 is a rotating machining tool which presses ductile sheet stock 210 against combustor liner 22 at the locations of holes formed by rotary punch 100. Ductile sheet stock 210 is a sheet of consumable ductile material through which rolling die 208 applies pressure to deform combustor liner 22 into a desired shape.

The formation of apertures 104*a*, 104*b*, 104*c*, and 104*c* may require applications of a combination of rotary punch 200, embossing die 204, and rolling die 208. Aperture 104*a* may, for instance, be formed by iteratively punching and embossing combustor liner 22 using a variety of rotary punches 200 and embossing dies 204. Aperture 104*a* is formed over multiple such iterations, such that aperture wall surface 106*a* of resulting aperture 104*a* converges from an opening at first surface 100*a* to narrower opening at second surface 102*a* (see FIG. 2A).

Aperture geometries of the present invention, such as illustrated in FIGS. 2A-2D, provide increased substrate adhesion area as compared to the prior art, and significantly reduce stress on coating 108. In addition, these geometries allow airflow width w to be precisely controlled during machining of apertures 104 and deposition of coating 108 to produce a desired cross-sectional flow area.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method of forming a gas turbine engine component subject to extreme temperatures and pressures, the method comprising:

fabricating a wall having a first surface and a second surface which define opposite sides of the wall;

creating an airflow aperture that extends through the wall in a direction substantially perpendicular to the first surface, the airflow aperture defined by an aperture wall surface which extends from a first opening in the first surface to a second opening in the second surface, and which is flared at a juncture with the first surface such that the first opening has a greater cross-sectional flow area than the second opening; and depositing a high-pressure, high-temperature resistant coating on the first surface, adhered to a portion of the aperture wall surface adjacent the first opening, such that a minimum flow width w of the airflow aperture is reduced and defined by the high-pressure, high-temperature resistant coating, where $$w = \frac{W_{major} - W_{minor}}{2} - 2t\sin\Theta,$$

$W_{major}$ is a maximum uncoated width of the airflow aperture, $W_{minor}$ is a minimum uncoated width of the airflow aperture, t is a thickness of the high-pressure, high-temperature resistant coating, and Θ is a surface angle between the aperture wall surface and a line normal to the first surface.

2. The method of claim 1, wherein the gas turbine engine component is a gas turbine combustor liner or afterburner liner.

3. The method of claim 1, wherein the aperture wall surface is substantially perpendicular to the first and second surfaces where adjacent the second surface.

4. The method of claim 1, wherein the high pressure, high temperature resistant coating is adhered in a uniform thickness.

5. The method of claim 4, wherein the portion of the aperture wall surface adjacent the first surface has cross-sectional profile with a radius of curvature greater than or equal to the uniform thickness of the high pressure, high temperature resistant coating.

6. The method of claim 1, wherein the portion of the aperture wall surface adjacent the first surface has a substantially frusto-conical cross-sectional profile.

7. The method of claim 6, wherein the aperture wall surface has a frusto-conical cross-sectional profile from the first surface to the second surface.

8. The method of claim 1, wherein the high pressure, high temperature resistant coating is a ceramic-based protective coating.

9. The method of claim 1, wherein the first and second openings are substantially circular.

10. The method of claim 1, wherein at least one of the first or second openings is elliptical.

11. A gas turbine engine component subject to extreme temperatures and pressures, the gas turbine engine component comprising:

a wall having a first surface and a second surface which define opposite sides of the wall, and an airflow aperture that extends entirely through the wall, the airflow aperture defined by an aperture wall surface which meets the first surface in a hole perimeter, such that the aperture wall surface is angled at a uniform obtuse angle relative to the first surface at this hole perimeter; and a high-pressure, high-temperature resistant coating adhered to the first surface, and adhered to a portion of the aperture wall surface adjacent the first opening, such that a minimum flow width w of the airflow aperture is reduced and defined by the high-pressure, high-temperature resistant coating, such that $$w = \frac{W_{major} - W_{minor}}{2} - 2t\sin\Theta,$$

where $W_{major}$ is a maximum uncoated width of the airflow aperture, $W_{minor}$ is a minimum uncoated width of the airflow aperture, t is a thickness of the high-pressure, high-temperature resistant coating, and Θ is a surface angle between the aperture wall surface and a line normal to the first surface.

12. The gas turbine engine component of claim 11, wherein the wall is a gas turbine engine combustor liner or afterburner liner.

13. The gas turbine engine component of claim 11, wherein the wall is an airfoil blade or vane surface.

14. The gas turbine engine component of claim 11, wherein the high-pressure, high-temperature resistant coating comprises a ceramic-based plasma spray coating.

15. The gas turbine engine component of claim 14, wherein the ceramic-based coating is a thermal barrier coating.

16. The gas turbine engine component of claim 11, wherein the aperture wall surface has a substantially frusto-conical cross-section at the hole perimeter.

17. The gas turbine engine component of claim 11, wherein the aperture wall surface is curved continuously with the first surface at the hole perimeter.

18. The gas turbine engine component of claim 11, wherein the hole perimeter is elliptical.

19. The gas turbine engine component of claim 11, wherein the aperture wall surface is substantially perpendicular to the first and second surfaces where adjacent the second surface.

* * * * *